US011939818B2

(12) United States Patent
Comeau et al.

(10) Patent No.: US 11,939,818 B2
(45) Date of Patent: Mar. 26, 2024

(54) MODULAR REAMER

(71) Applicant: T. J. Technology Ltd., Leduc (CA)

(72) Inventors: Laurier E. Comeau, Calgary (CA); Jayson Russell, Calgary (CA)

(73) Assignee: T.J. TECHNOLOGY 2020 INC., Leduc (CA)

( * ) Notice: Subject to any disclaimer, the term of this patent is extended or adjusted under 35 U.S.C. 154(b) by 1 day.

(21) Appl. No.: 17/457,245

(22) Filed: Dec. 1, 2021

(65) Prior Publication Data

US 2023/0167690 A1 Jun. 1, 2023

(51) Int. Cl.
*E21B 10/26* (2006.01)

(52) U.S. Cl.
CPC ..... *E21B 10/26* (2013.01)

(58) Field of Classification Search
CPC . E21B 10/26; E21B 7/28; E21B 10/16; E21B 17/1078
See application file for complete search history.

(56) References Cited

U.S. PATENT DOCUMENTS

| | | | | |
|---|---|---|---|---|
| 4,560,013 | A | 12/1985 | Beimgraben | |
| 5,180,021 | A | 1/1993 | Champion et al. | |
| 8,752,649 | B2 | 6/2014 | Isenhour | |
| 8,813,877 | B1 | 8/2014 | Short, Jr. et al. | |
| 8,851,205 | B1 | 10/2014 | Short, Jr. et al. | |
| 9,151,119 | B1 | 10/2015 | Smith | |
| 9,163,460 | B2 | 10/2015 | Senhour et al. | |
| 9,410,379 | B2 | 8/2016 | Silva | |
| 9,657,526 | B2 | 5/2017 | Short, Jr. et al. | |
| 2014/0008127 | A1* | 1/2014 | Plessis | E21B 17/046 175/55 |
| 2017/0198527 | A1 | 7/2017 | Delwiche et al. | |
| 2019/0226285 | A1* | 7/2019 | Teodorescu | E21B 7/28 |
| 2019/0292857 | A1* | 9/2019 | Short, Jr. | E21B 7/28 |

FOREIGN PATENT DOCUMENTS

| | | | |
|---|---|---|---|
| CN | 211342813 | U | 8/2020 |
| GB | 1532733 | A | 11/1978 |
| RU | 2026950 | C1 | 1/1995 |

* cited by examiner

*Primary Examiner* — Caroline N Butcher
(74) *Attorney, Agent, or Firm* — Schafer IP Law; Richard A. Schafer

(57) ABSTRACT

A modular reamer for use in a wellbore comprises an uphole end member, a center member, and a downhole member, with reamer sleeves that removably slides over a sleeve mounting portion of the center member or one of the end members, and are held between the end members and the center members when assembled into a downhole tool. The reamer sleeves may be positioned at any desired rotational angle relative to each other and are prevented from rotational movement relative to the center member by spines or keys formed on the mating surfaces of the reamer sleeves and corresponding members of the modular eccentric reamer.

19 Claims, 8 Drawing Sheets

MODULAR REAMER

TECHNICAL FIELD

The present invention relates to the field of drilling wellbores, and in particular to a modular device for increasing the drift diameter and improving the quality of a wellbore.

BACKGROUND ART

Horizontal, directional, S-curve, and most vertical wells are drilled with a bit driven by a bent housing downhole mud/air motor, which can be oriented to build or drop angle and can steer right or left. The drill string is oriented to point the bent housing mud/air motor in the desired direction, commonly called "sliding." Sliding forces the drill bit to navigate along the desired path, with the rest of the drill string following.

Repeated correcting of the direction of the wellbore causes micro-ledging and "doglegs," inducing friction and drag between the wellbore and the bottom hole assembly and drill string. This undesired friction causes problems in the drilling process, including increasing torque and drag, ineffective weight transfer to the bit, eccentric wearing on the drill string and bottom hole assembly (BHA), increasing the time to drill the well, drill string failures, limiting the distance the wellbore can be extended, issues with removing the drill string and BHA from the borehole, and issues related to inserting the production string into the wellbore. The borehole can also become spiraled or tortuous even while rotating or drilling with a rotary steerable assembly.

When a dogleg, spiraled path, or tortuous path is cut by a drill bit, the relatively unobstructed passageway following the center of the wellbore may yield a smaller diameter than the wellbore itself. This relatively unobstructed passageway is sometimes referred to as the "drift" and the nominal diameter of the passageway is sometimes referred to as the "drift diameter". The "drift" of a passageway is generally formed by wellbore surfaces forming the inside radii of curves along the path of the wellbore. Passage of pipe or tools through the relatively unobstructed drift of the wellbore is sometimes referred to as "drift" or "drifting.

In general, to address these difficulties the drift diameter has been enlarged with conventional reaming techniques by enlarging the diameter of the entire wellbore. Such reaming has been completed as an additional step, after drilling of the wellbore is completed. Doing so has been necessary to avoid unacceptable increases in torque and drag during drilling. Such additional reaming runs add considerable expense and time to the completion of the well. Moreover, conventional reaming techniques frequently do not improve the wellbore, but instead simply enlarge certain areas of the wellbore.

Although eccentric reamers have been produced for some time to provide some of these capabilities, the tools lack flexibility of design and diameter and often lack serviceability requiring an operator to stock multiple fixtures in the field to avoid downtime while a reamer is sent for repairs.

SUMMARY OF INVENTION

In one aspect, a downhole tool comprises: a first end member; a center member, threadedly connected to the first end member; a second end member, threadedly connected to the center member; a first removable sleeve, held in place between a shoulder of the first end member and a first shoulder of the center member; and a second removable sleeve, held in place between a second shoulder of the center member and a shoulder of the second end member, wherein the first removable sleeve and the second removable sleeve are separately positionable at a plurality of rotational angles relative to the center member.

In a second aspect, a removable reamer sleeve for a downhole tool comprises: a sleeve body; a plurality of cutter blades formed on an outer surface of the sleeve body; and a plurality of splines formed longitudinally about an inner surface of the sleeve body, configured for slidable engagement with a corresponding plurality of spines formed on a member of the downhole tool.

In a third aspect, a method of reaming a wellbore comprises: rotating a first reamer sleeve to a first rotational angle relative to a center member of a modular reamer tool; sliding the first reamer sleeve onto a first end of the center member of the modular reamer tool; connecting the center member of the modular reamer tool with a first end member of the modular reamer tool, wherein the first reamer sleeve is disposed between a shoulder of the first end member and a first shoulder of the center member; coupling the modular reamer tool to a drill string; and rotating the drill string in the wellbore.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

In the following description, for purposes of explanation, numerous specific details are set forth in order to provide a thorough understanding of the invention. It will be apparent, however, to one skilled in the art that the invention may be practiced without these specific details. References to numbers without suffixes are understood to reference all instances of suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

The following discussion is written generally in terms of a modular reamer with two eccentric reamer sleeves, but is not limited to such a downhole tool. Embodiments may use one or more concentric reamer sleeves, stabilizer sleeves, and other types of sleeves for other purposes known to the art.

Using a pair of diametrically opposed eccentric reamers allows an operator to increase the drift diameter of a wellbore, which may provide improved reaming of wellbores over concentric reamer tools because the diametrically opposed reamers cut away material primarily forming surfaces nearer the center of the drift.

Figure 1:
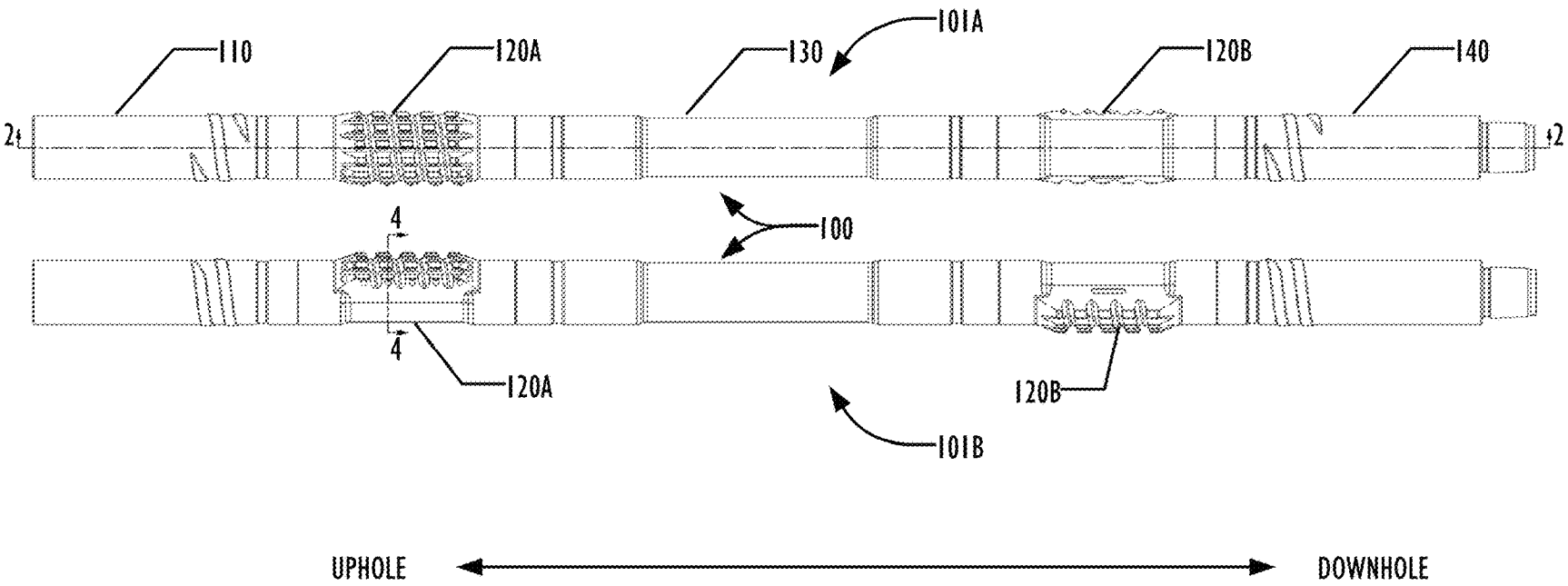
FIG. 1 is two elevation views illustrating a modular eccentric reamer according to one embodiment.

FIG. 1 is a pair of elevation views 101A, 101B illustrating a wellbore reaming tool that is a modular eccentric reamer 100 according to one embodiment. Elevation views 101A and 101B illustrate the modular eccentric reamer 100 at two different rotational orientations, approximately 90° apart. The modular eccentric reamer 100 comprises 5 members: an uphole end member 110, an uphole reamer sleeve 120A, a center member 130, a downhole reamer sleeve 120B, and a downhole end member 140. Both the uphole reamer sleeve 120A and the downhole reamer sleeve 120B are removable from the modular eccentric reamer 100. The uphole and downhole reamer sleeves 120A-B are preferably of identical construction and are preferably at diametrically opposed rotational angles (i.e. at an angular displacement of approximately 180°) on the center member 130. However other angular displacements can be used, for example, 120°, 140°. 210°, or 240°. The cutting elements of each of the uphole and downhole reamer sleeves 120A-B face in the same direction rotationally, so that both sleeves will cut when the pipe is turned in a right-hand direction. In other embodiments, uphole and downhole reamer sleeves 120A-B may be of different design and shape or other types of sleeves may be deployed to vary the performance of the downhole tool 100. For example, a stabilizer sleeve may be substituted for one or both of the uphole and downhole reamer sleeves 120A-B illustrated in FIG. 1. In another example, a concentric reamer sleeve may be substituted for one or both of the uphole and downhole reamer sleeves 120A-B.

The reamer sleeves 120A-B are spaced apart and positioned to run behind the bottom hole assembly (BHA). In one embodiment, for example, the modular eccentric reamer 100 with the eccentric reamer sleeves 120A-B is positioned within a range of approximately 100 to 140 feet from the BHA. Although two reamer sleeves 120 are shown, other numbers of reamer sleeves 120 could be used in the alternative. As shown, the drill string advances to the right (downhole) as the well is drilled. Each of the reamer sleeves 120A-B has an outermost diameter or radial height, generally in the area of its cutting elements, which may be different from the inner diameter of the wellbore. For example, in a 6.750-inch diameter hole, the blades of the reamer sleeves 120A-B may have a diameter of 6.625 inches (less than the diameter of the wellbore) or may have a diameter of 6.875 inches (greater than the diameter of the wellbore) as desired. However, the outermost radius of each reamer sleeve 120A-B is preferably greater than the distance of the nearer surfaces from the center of drift. The uphole and downhole reamer sleeves 120A-B preferably comprise a plurality of carbide or diamond cutting elements, with each cutting element preferably having a circular face generally facing the path of movement of the cutting element relative to the wellbore as the drill string rotates and advances downhole. In FIG. 1, the downhole reamer begins to engage and cut a surface nearer the center of drift of the wellbore. As will be appreciated, the reamer sleeves, when rotated, cut away portions of the nearer surface of the wellbore, while cutting substantially less or none of the surface farther from the center of drift, generally on the opposite side of the wellbore.

Each of reamer sleeves 120A, 120B can be disposed on the modular eccentric reamer 100 at any of a plurality of rotational orientations that can be separately repositioned in the field or elsewhere by disassembling the modular eccentric reamer 100, rotating the reamer sleeve 120A or 120B or both relative to the center member 130 to their desired orientations, then reassembling the modular eccentric reamer 100 with the elements in those rotational orientations. Various embodiments may provide for any desired number of rotational orientations as described in more detail below, including aligned orientations. If either of reamer sleeves 120A, 120B require repair or refurbishment, the modular eccentric reamer 100 can be partially disassembled, the relevant reamer sleeve 120A or 120B be removed and replaced, and the modular eccentric reamer 100 reassembled. Similarly, if a reamer with different characteristics is desired, the replaceability of the reamer sleeves 120A, 120B allows an operator to assemble the modular eccentric reamer 100 from a kit of reamer sleeves 120A, 120B of different reamer characteristics, from a kit of center members 130 of different lengths or diameters, or both, instead of maintaining an inventory of complete eccentric reamer tools.

Embodiments of the modular eccentric reamer 100 employ reamer sleeves 120A, 120B that slide onto one of the end members 110, 140 or center member 130 and are then held in place between the respective end member 110, 140 and center member 130.

Although not shown in FIG. 1, additional features can be added to the center member 130, such as stabilizer, hole cleaning, and stress relief features. In addition, center members 130 of different diameters can be provided to adjust the diameter of the center member 130, which will affect how much the cutting areas of reamer sleeves 120A-B contact formation in a hole section where drift diameter is decreased due to tortuosity. The length of the center member may also be changed to adjust spacing between the uphole and downhole reamer sleeves 120A-B, which may lead to improved performance depending upon spiral spacing within the borehole.

Figure 2:
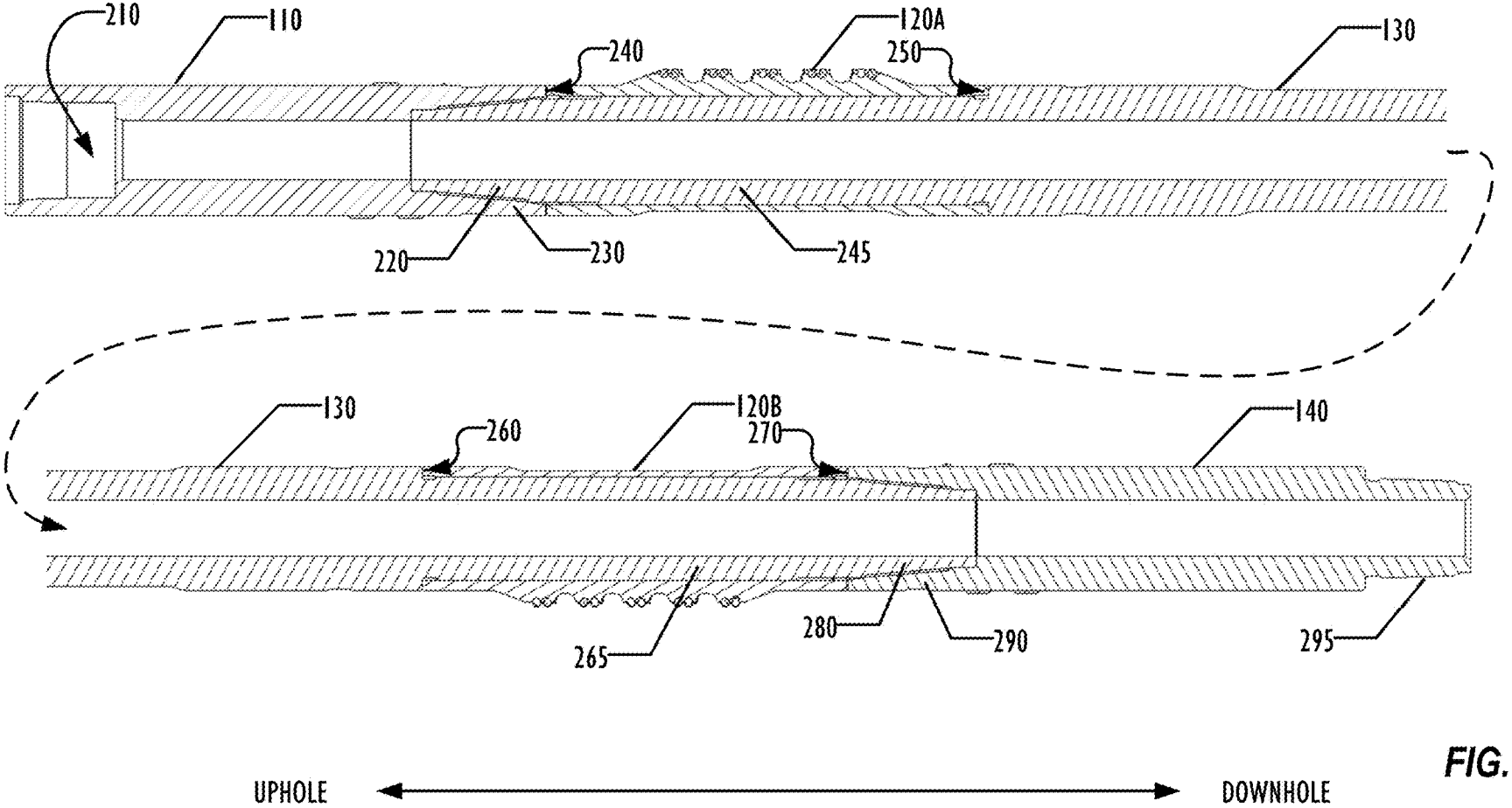
FIG. 2 is a cutaway view of the modular eccentric reamer of FIG. 1 along line 1-1.

FIG. 2 is a cutaway view of a modular eccentric reamer 100 along axis 2-2, providing more details about the connection of the various elements. Uphole end member 110 typically is connected to the rest of the drill string by a box connection 210, while downhole end member 140 is connected to the rest of the drill string by a pin connection 295. Because end members 110 and 140 can be easily replaced on the modular eccentric reamer 100, replacement end members 110 and 140 can be deployed on the modular eccentric reamer 100 easily with different threading as necessary, instead of having to cut off the existing thread and rethread the end member 110, 140. The end members 110, 140, which frequently limit tool life due to thread cutbacks, can easily be replaced. Thus, end members 110, 140 can be changed out based on a required connection type on the drill rig, eliminating the need for constant recuts (which reduce tool life) or renting of cross-over housings to convert between different drill string thread characteristics.

Center member 130 may be threadedly connected with the uphole end member 110 using any desired type of threaded connection. As illustrated in FIG. 2, a male threaded end 220 of center member 130 is threaded into a female threaded end 230 of uphole end member 110, making a connection such as an NC40 connection. Similarly, a male threaded end 280 of center member 130 is illustrated in FIG. 2 as threaded into a female threaded end 290 of the downhole end member 140. However other connection types can be used if desired.

Each of the reamer sleeves 120A-B are manufactured to slide onto a sleeve mounting portion 245, 265 of the center member 130 before connecting the uphole and downhole end members 110, 140 to the center member 130. A shoulder 240 of the uphole end member 110 abuts an uphole end of the reamer sleeve 120A and a shoulder 250 of the center member 130 abuts a downhole end of the reamer sleeve 120A, holding the reamer sleeve 120A between the uphole end member 110 and center member 130. Although not illustrated in FIG. 2, sleeve mounting portions 245, 265 of the center member and the reamer sleeves 120A-B are configured to allow repositioning the rotational angle of the reamer sleeves 120A-B and to prevent rotation of the reamer sleeves 120A-B while installed onto the corresponding sleeve mounting portions 245, 265. Details of that anti-rotation mechanism are described below in the descriptions of FIGS. 3 and 4.

In an alternate embodiment, the sleeve mounting portions 245, 265 may be formed in the uphole end member 110 and downhole end member 140, with corresponding changes to the connections between the end members 110, 140 and the center member 130. The reamer sleeves 120 in such an embodiment would thus be mounted on the end members 110, 140 instead of the center member 130, but would otherwise be unchanged. In a further alternate embodiment, one of the sleeve mounting portions 245, 265 may be formed on the corresponding end members 110, 140, and the other of the sleeve mounting portions 245, 265 may be formed on the center member 130 as illustrated in FIG. 2. In each of these alternate embodiments, the shoulders 240, 250, 260, and 270 would remain to help position and retain the reamer sleeves 120A-B between the end members 110, 140 and the center member 130.

Figure 3:
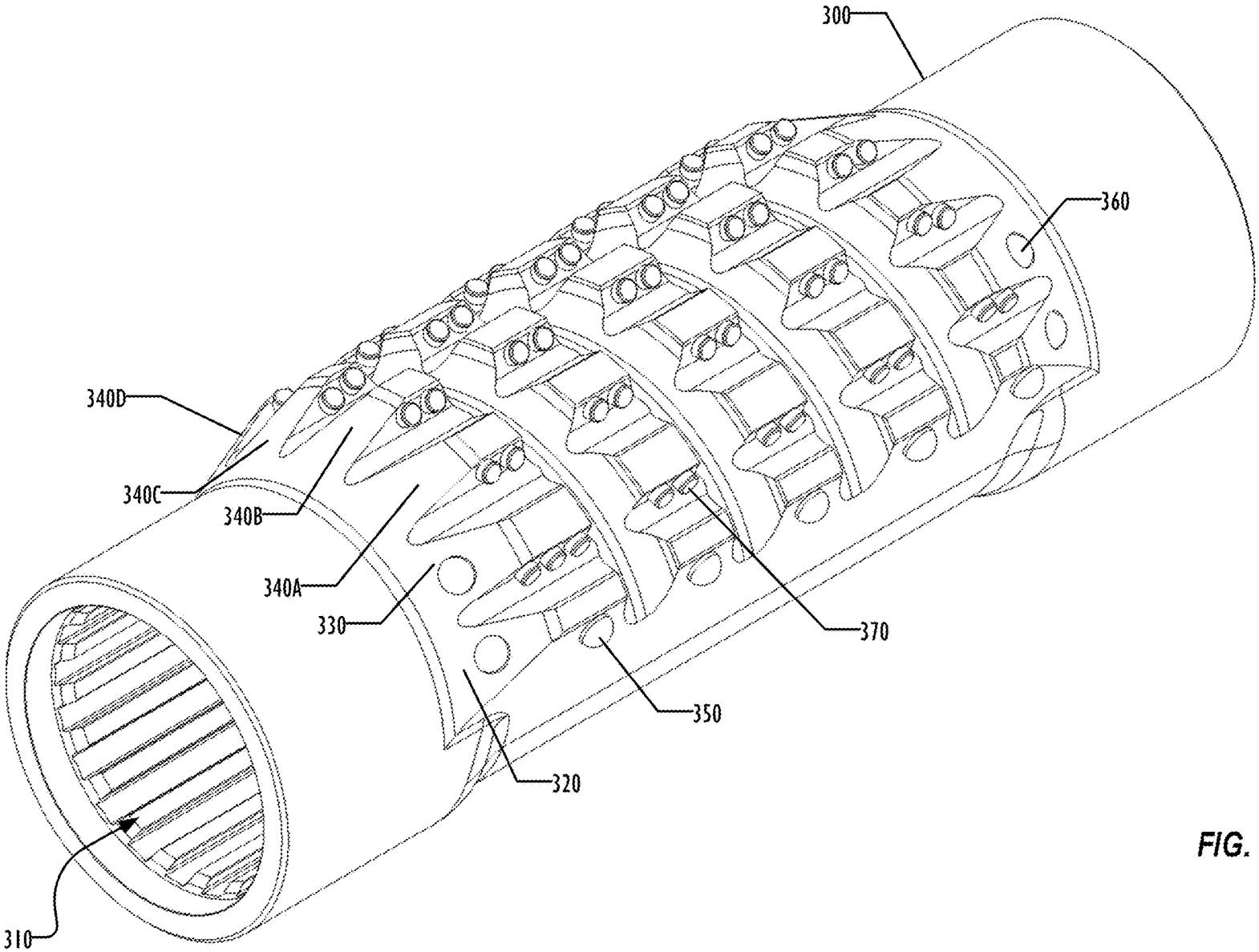
FIG. 3 is an isometric view of a reamer sleeve member according to one embodiment for use with the modular eccentric reamer of FIG. 1.

FIG. 3 is an isometric view illustrating a reamer sleeve 300 for use as the reamer sleeve 120A-B of FIGS. 1-2. An inner surface 310 of the reamer sleeve 300 is keyed or splined with a plurality of keys or splines that are configured for slidable engagement with corresponding keys or splines on an outer surface 410 of the sleeve mounting portions 245, 265 of the center member 130 that are proximal to the uphole and downhole ends of the center member 130. The matching keys or splines prevent the reamer sleeve from rotating relative to the center member 130 once the reamer sleeve 300 slides onto the sleeve mounting portions 245, 265 of the center member 130.

As illustrated in FIG. 3, the reamer sleeve 300 inner surface 310 has 20 keys or splines, allowing the reamer sleeve 300 to be rotated in 18° rotations. The number of keys or splines is illustrative and by way of example only, and any desired plurality of keys or splines may be formed on the inner surface 310 and outer surface 410 of the sleeve mounting portions 245, 265 of the center member 130, with corresponding changes in the size and number of possible rotations of the reamer sleeve 300 relative to the center member 130. Other techniques for maintaining the rotational orientation of the reamer sleeve 300 may be employed. For example, pins, flats, or grooves on the inner surface of the sleeve 300 or on the sleeve mounting portions 245, 265 of the center member 130 may be employed.

A plurality of cutter blades is formed on and extending from an outer surface of the reamer sleeve 300 to perform the cutting or reaming action when deployed downhole. Each cutter blade has a thickness that decreases as the cutter blade extends radially outward from the outer surface of the reamer sleeve 300. In the embodiment illustrated in FIG. 3, the reamer sleeve 300 comprises six cutter blades: a first cutter blade 320, a second cutter blade 330, and four additional cutter blades 340A, 340B, 340C, and 340D. The leading edge cutter blades 320 and 330 of the reamer sleeve 300 may have a slightly lower radial height than the four additional cutter blades 340A-340D, each of which may have equal radial height. Each of the cutter blades 320, 330, and 340A-340D are divided into five sub-blades, which are not individually numbered in FIG. 3. Each sub-blade may have hardfacing or a coating to increase hardness, using any desired type of hardfacing or coating material known in the art. The hardfacing or coating may be disposed on a portion, such as a radially outmost portion of the sub-blade, or the entire sub-blade. Each of the cutter blades and sub-blades can vary in shape and thickness and may be any suitable shape as selected for a particular application. Each of the cutter blades and sub-blades may be machined into or otherwise integrally formed on the outer surface of the reamer sleeve 300 to the desired diameter. As illustrated in FIG. 3, each cutter blade 320, 330, and 340A-D extend along a surface of the reamer sleeve 300 parallel to each other and parallel to a longitudinal axis of the body of the reamer sleeve 300. However, embodiments of the reamer sleeve 300 may use cutter blades that are arranged in a spiral or helical path along the reamer sleeve 300.

Each of the sub-blades in cutter blades 330 and 340A-340D may comprise one or more carbide or polycrystalline diamond compact (PDC) cutter elements 370 oriented in the direction of rotation. As illustrated, most of the sub-blades have two cutter elements 370, but one of the sub-blades in cutter blade 330 has three cutter elements 370 and one of the sub-blades (not visible in FIG. 3) has only one cutter element 370. Embodiments of the reamer sleeve 300 sub-blades may have any desired number of cutter elements 370, generally limited by the available space. Grooves or flutes may be formed between each sub-blade of the cutter blades 320, 330, and 340A-340D to allow cuttings and drilling mud to flow past the reamer sleeve 300 and exit away from the reamer sleeve 300 during operation. Although illustrated in the Figures as circular at the face of the cutter elements 370, the shape of the cutter elements 370 may be circular or any polygonal shape. Some of the leading and trailing cutter elements may be below the full gauge of the blades on which the cutter elements are mounted.

The uphole and downhole ends of rotational leading cutter blades 320 and 330 may also comprise diamond domes 360. Instead of cutter elements 370, each of the sub-blades of the rotational leading cutter blade 320 comprises one or more diamond domes. The diamond domes eliminate casing damage and protect the cutter element while the reamer sleeve 300 rotates in the casing and during trips and drill-outs. Additionally, diamond domes help to limit cutter damage and torque when reaming out ledges or key-seats within the borehole.

Figure 4:
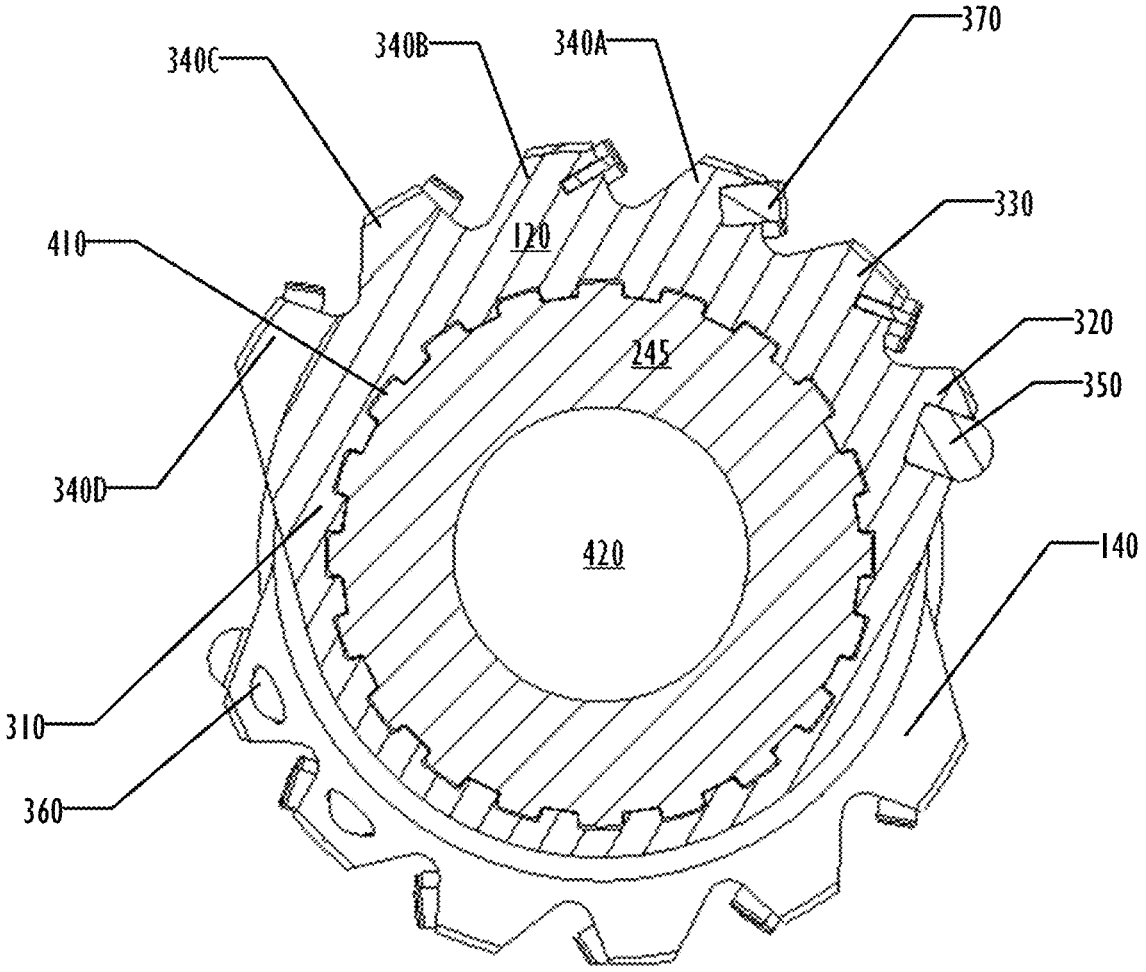
FIG. 4 is a cross-sectional view of the modular eccentric reamer of FIG. 1 along plane 4-4.

FIG. 4 is a cross-sectional view illustrating a cross-section of a modular eccentric reamer 100 along line 4-4. FIG. 4 depicts how the inner surface 310 of the reamer sleeve 120 engages with the outer surface 410 of the sleeve mounting portion 245 of the center member 130, preventing rotation of the reamer sleeve 300 relative to the center member 130 once the inner surface 310 is engaged with the outer surface 410, As can also be seen in FIG. 4, the cutter elements 370 and diamond domes 350 are inset into the cutter blades 320, 330, and 340A-340D. Also visible in FIG. 4 is the uphole end of reamer sleeve 120B, showing the diamond domes 360 on the uphole of the cutter blades of the reamer sleeve 120B. A through bore 420 is also illustrated in FIG. 4. As illustrated in FIGS. 1, 2, and 4, reamer sleeves 120A-B are positioned rotationally opposite to each other, with the cutter blades at the top and bottom (from the perspective of line 2-2). However, each reamer sleeves 120A-B may be positioned at any other desired rotational angle provided by the splined or keyed interaction of inner surface 310 and outer surface 410 and need not be rotationally oriented in opposite directions as illustrated in FIGS. 1, 2, and 4.

As the modular eccentric reamer tool 100 is pulled into the near side of a crook in the wellbore, the cutter elements 370 rotate about the center axis of the center member 130 and cut into the near side of the wellbore without cutting into the opposite side. This cutting action may act to straighten the crooked wellbore, remove any ledges and condition the wellbore.

The number of cutter blades, sub-blades within cutter blades, and cutter elements mounted in the sub-blades illustrated in the Figures are illustrative and by way of example only. Other numbers, types, and orientations of cutter blades, sub-blades, and cutter elements may be used as desired.

Figure 5:
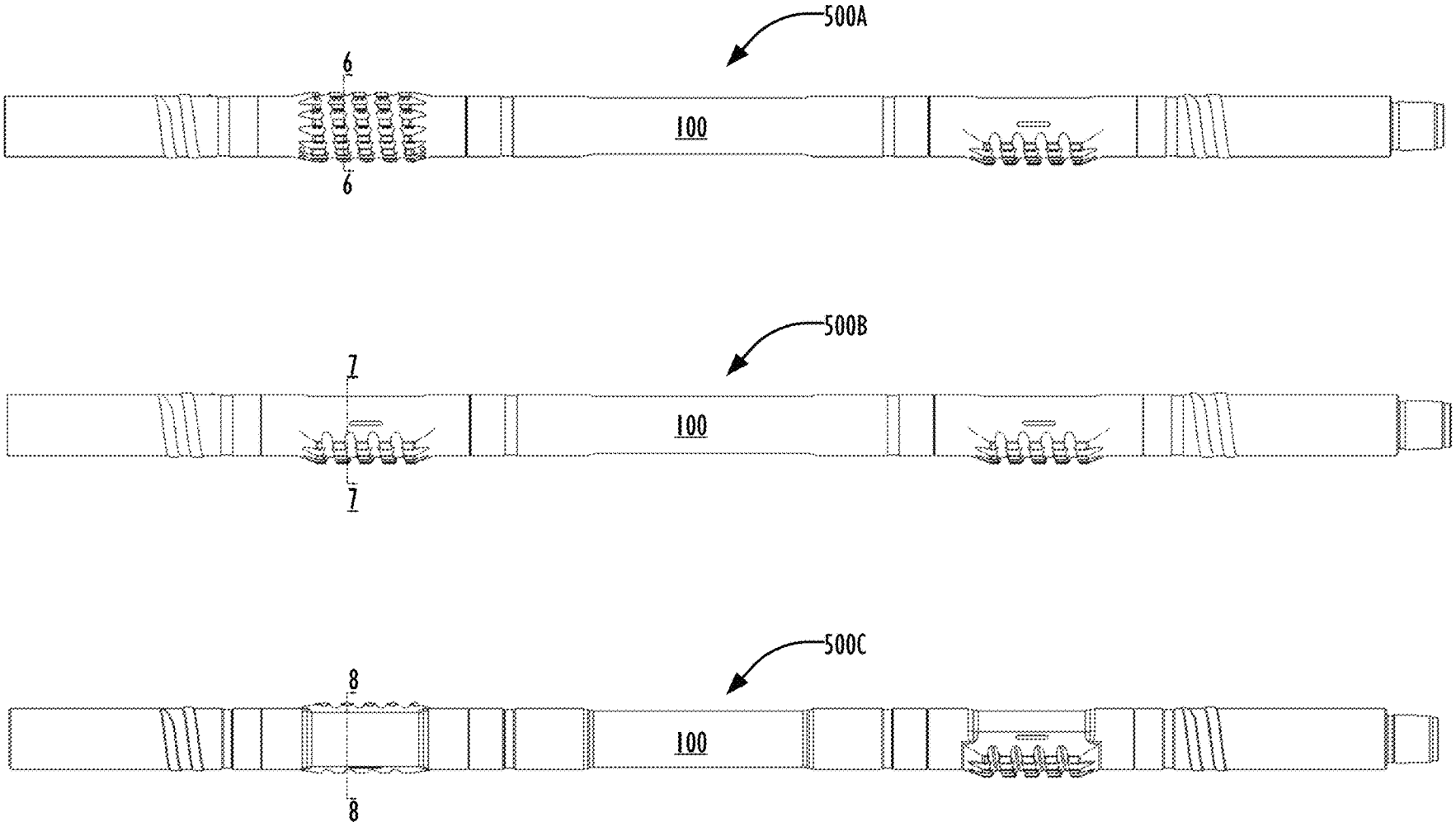
FIG. 5 is a collection of three elevation views of a modular eccentric reamer with different orientations of reamers.
Figure 6:
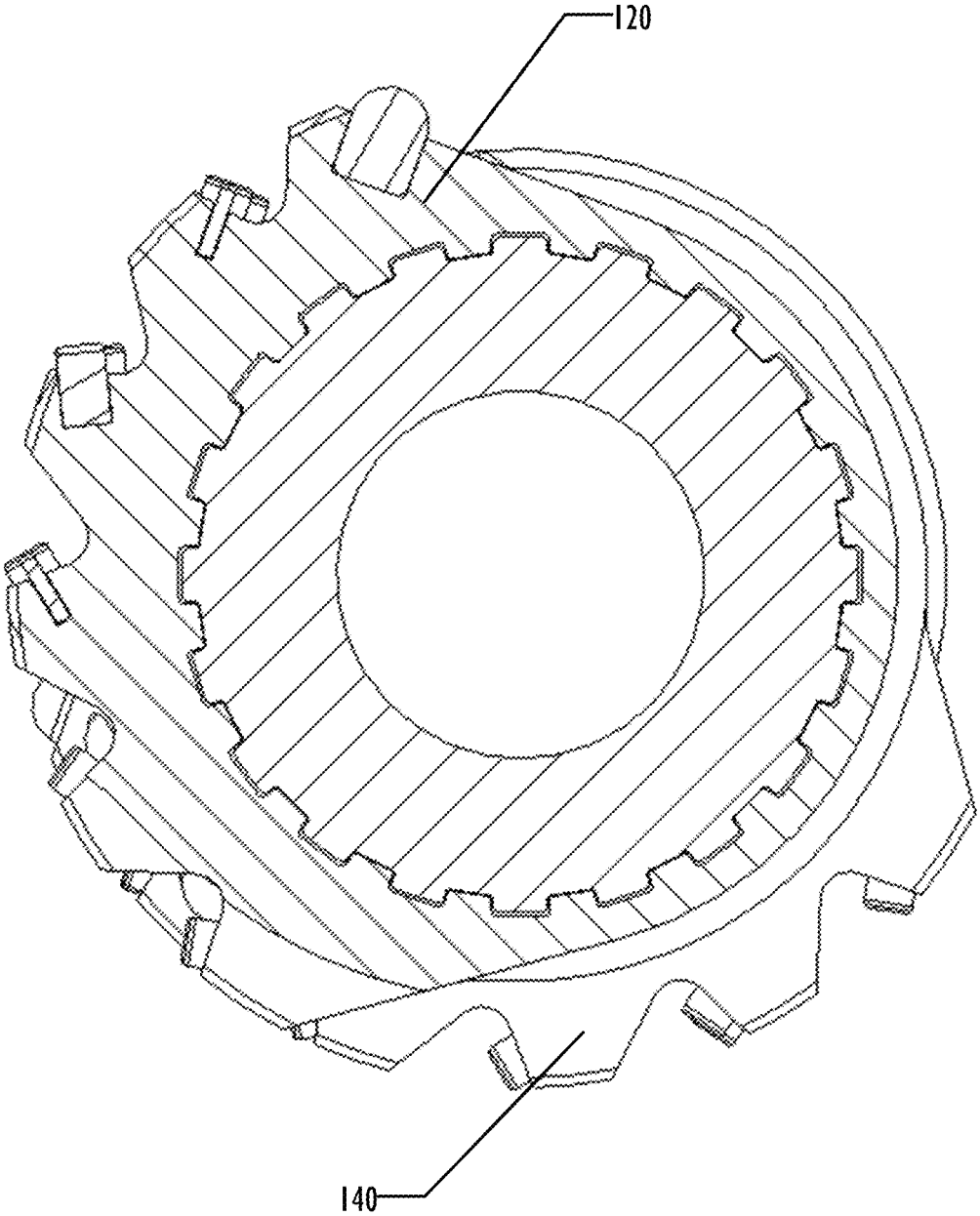
FIGS. 6-8 are cross-sectional views of the modular eccentric reamer of FIG. 5 with reamer sleeves in various relative orientations.
Figure 7:
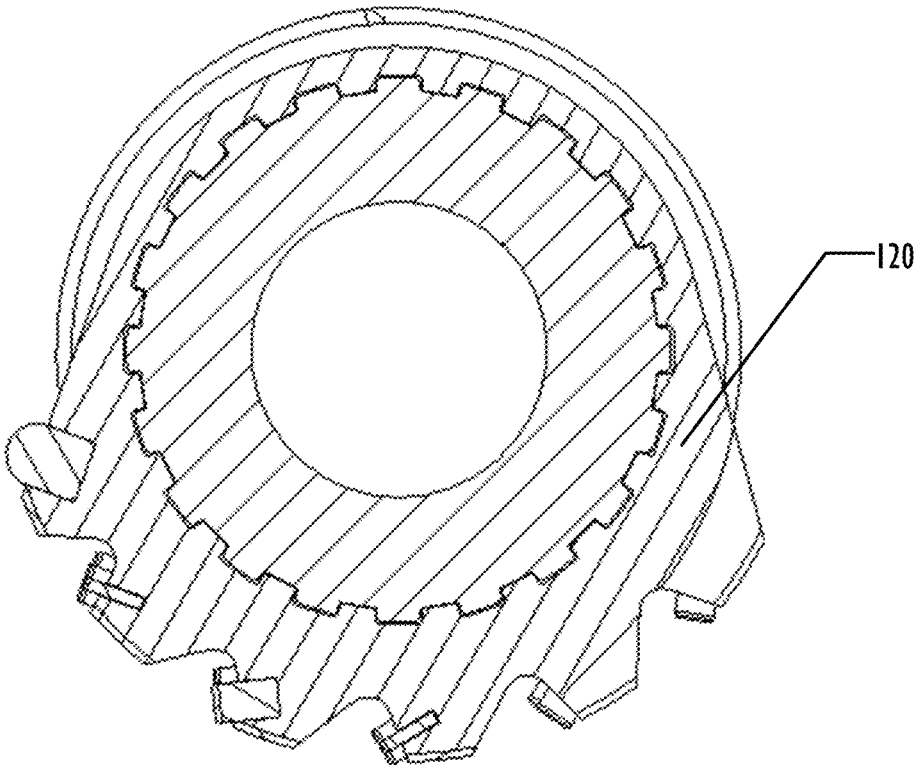
Figure 8:
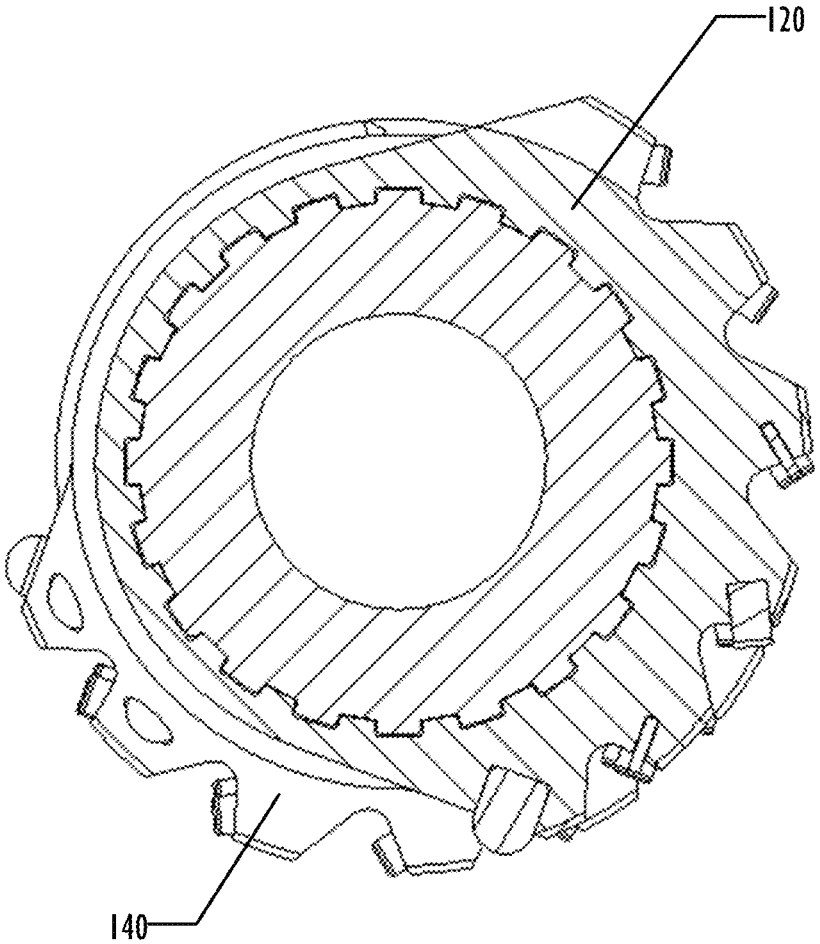

FIG. 5 is a collection of elevation views 500A-C illustrating a module reamer with reamer sleeves in various relative rotational orientations. FIG. 6 is a cross-sectional view along plane 6-6 in which the two reamer sleeves 120, 140 are in a 270° relative orientation. FIG. 7 is a cross-sectional view along plane 7-7 in which the two reamer sleeves 120, 140 are aligned. FIG. 8 is a cross-sectional view along plane 8-8 in which the two reamer sleeves 120, 140 are in a 90° relative orientation.

Other example embodiments include the following:

Example 1 is a downhole tool, comprising: a first end member; a center member, threadedly connected to the first end member; a second end member, threadedly connected to the center member; a first removable sleeve, held in place between a shoulder of the first end member and a first shoulder of the center member; and a second removable sleeve, held in place between a second shoulder of the center member and a shoulder of the second end member, wherein the first removable sleeve and the second removable sleeve are separately positionable at a plurality of rotational angles relative to the center member.

In Example 2 the subject matter of Example 1 optionally includes wherein the second removable sleeve is identical to the first removable sleeve.

In Example 3 the subject matter of Example 1 optionally includes wherein the first removable sleeve comprises a splined inner surface, wherein the center member comprises a correspondingly splined sleeve mounting portion, and wherein the first removable sleeve is disposed on the center member by sliding the splined inner surface of the first removable sleeve over the correspondingly splined sleeve mounting portion of the center member.

In Example 4 the subject matter of Example 1 optionally includes wherein the first removable sleeve is disposed on the center member by sliding the first removable sleeve over a sleeve mounting portion of the center member.

In Example 5 the subject matter of Example 1 optionally includes wherein the first removable sleeve is a first eccentric reamer sleeve and the second removable sleeve is a second eccentric reamer sleeve.

In Example 6 the subject matter of Example 1 optionally includes wherein the first removable sleeve comprises a plurality of blades aligned parallel to a longitudinal axis of the center member.

In Example 7 the subject matter of Example 1 optionally includes wherein the first removable sleeve comprises a first plurality of blades of equal radial height relative to an outer surface of the center member.

In Example 8 the subject matter of Example 7 optionally includes wherein the first removable sleeve further comprises a second plurality of blades of a lower radial height than the first plurality of blades.

Example 9 is a removable reamer sleeve for a downhole tool, comprising: a sleeve body; a plurality of cutter blades formed on an outer surface of the sleeve body; and a plurality of splines formed longitudinally about an inner surface of the sleeve body, configured for slidable engagement with a corresponding plurality of spines formed on a member of the downhole tool.

In Example 10 the subject matter of Example 9 optionally includes wherein each of the cutter blades is divided into a plurality of sub-blades by grooves formed between the sub-blades.

In Example 11 the subject matter of Example 10 optionally includes wherein a first sub-blade of the plurality of sub-blades comprises a first number of cutter elements, and wherein a second sub-blade of the plurality of sub-blades comprises a second number of cutter elements, different from the first number.

In Example 12 the subject matter of Example 9 optionally includes wherein the plurality of cutter blades are aligned in parallel to a longitudinal axis of the sleeve body.

In Example 13 the subject matter of Example 9 optionally includes wherein the plurality of cutter blades comprises: a first plurality of cutter blades of equal radial height; and a second plurality of cutter blades of lower radial height than the first plurality of cutter blades.

In Example 14 the subject matter of Example 9 optionally includes wherein a plurality of diamond domes are mounted in a rotationally leading cutter blade of the plurality of cutter blades.

Example 15 is a method of reaming a wellbore, comprising: rotating a first reamer sleeve to a first rotational angle relative to a center member of a modular reamer tool; sliding the first reamer sleeve onto a first end of the center member of the modular reamer tool; connecting the center member of the modular reamer tool with a first end member of the modular reamer tool, wherein the first reamer sleeve is disposed between a shoulder of the first end member and a first shoulder of the center member; coupling the modular reamer tool to a drill string; and rotating the drill string in the wellbore.

In Example 16 the subject matter of Example 15 optionally further comprises: rotating a second reamer sleeve to a second rotational angle relative to the center member; sliding the second reamer sleeve onto a second end of the center member; and connecting the center member with a second end member of the modular reamer tool, wherein the second reamer sleeve is disposed between a shoulder of the second end member and a second shoulder of the center member.

In Example 17 the subject matter of Example 16 optionally further comprises: wherein the second rotational angle is different from the first rotational angle.

In Example 18 the subject matter of Example 15 optionally further comprises: disconnecting the first end member from the center member; sliding the first reamer sleeve off the center member; rotating the first reamer sleeve to a different rotational angle relative to the center member; and sliding the first reamer sleeve onto the first end of the center member.

In Example 19 the subject matter of Example 15 optionally includes wherein sliding the first reamer sleeve onto a first end of the center member of the modular reamer tool comprises: engaging a first plurality of splines on an inner surface of the first reamer sleeve slidably with a second plurality of splines on an outer surface of the first end of the center member, wherein the first plurality of splines and the second plurality of splines comprise an equal number of splines.

In Example 20 the subject matter of Example 16 optionally further comprises: removing the first end member from the modular reamer tool; and replacing the first end member with a replacement end member having different drill string thread characteristics.

While certain exemplary embodiments have been described in detail and shown in the accompanying drawings, it is to be understood that such embodiments are merely illustrative of and not devised without departing from the basic scope thereof, which is determined by the claims that follow.

We claim:

1. A downhole tool, comprising:

a first end member;

a center member, threadedly connected to the first end member;

a second end member, threadedly connected to the center member;

a first removable reamer sleeve, slidably disposed about a splined portion of the first end member or the center member and held in place between a shoulder of the first end member and a first shoulder of the center member; and a second removable reamer sleeve, slidably disposed about a splined portion of the first second end member or the center member and held in place between a second shoulder of the center member and a shoulder of the second end member, wherein each of the first removable reamer sleeve and the second removable reamer sleeve are separately positionable at a plurality of rotational angles relative to the center member, wherein the first removable reamer sleeve and the second removable reamer sleeve are configured for enlarging a borehole.

2. The downhole tool of claim 1, wherein the second removable reamer sleeve is identical to the first removable reamer sleeve.

3. The downhole tool of claim 1, wherein the first removable reamer sleeve comprises a splined inner surface, wherein the center member comprises a correspondingly splined sleeve mounting portion, and wherein the first removable reamer sleeve is disposed on the center member by sliding the splined inner surface of the first removable reamer sleeve over the correspondingly splined sleeve mounting portion of the center member.

4. The downhole tool of claim 1, wherein the first removable reamer sleeve is disposed on the center member by sliding the first removable reamer sleeve over a sleeve mounting portion of the center member.

5. The downhole tool of claim 1, wherein the first removable reamer sleeve is a first eccentric reamer sleeve and the second removable reamer sleeve is a second eccentric reamer sleeve.

6. The downhole tool of claim 1, wherein the first removable reamer sleeve comprises a plurality of blades aligned parallel to a longitudinal axis of the center member.

7. The downhole tool of claim 1, wherein the first removable reamer sleeve comprises a first plurality of blades of equal radial height relative to an outer surface of the center member.

8. The downhole tool of claim 7, wherein the first removable reamer sleeve further comprises a second plurality of blades of a lower radial height than the first plurality of blades.

9. A pair of removable reamer sleeves for a downhole tool, each comprising:

a sleeve body, held in place between a shoulder of a corresponding end member of the downhole tool and a corresponding shoulder of a center member of the downhole tool; and;

a plurality of cutter blades formed on an outer surface of the sleeve body, wherein the plurality of cutter blades are configured for enlarging a borehole; and a plurality of splines formed longitudinally about an inner surface of the sleeve body, configured for slidable engagement with a corresponding plurality of spines formed on the center member of the downhole tool.

10. The pair of removable reamer sleeves of claim 9, wherein each of the cutter blades is divided into a plurality of sub-blades by grooves formed between the sub-blades.

11. The pair of removable reamer sleeves of claim 10, wherein a first sub-blade of the plurality of sub-blades comprises a first number of cutter elements, and wherein a second sub-blade of the plurality of sub-blades comprises a second number of cutter elements, different from the first number.

12. The pair of removable reamer sleeves of claim 9, wherein the plurality of cutter blades are aligned in parallel to a longitudinal axis of the sleeve body.

13. The pair of removable reamer sleeves of claim 9, wherein the plurality of cutter blades comprises:

a first plurality of cutter blades of equal radial height; and a second plurality of cutter blades of lower radial height than the first plurality of cutter blades.

14. The pair of removable reamer sleeves of claim 9, wherein a plurality of diamond domes are mounted in a rotationally leading cutter blade of the plurality of cutter blades.

15. A method of reaming a wellbore, comprising:

rotating a first removable reamer sleeve to a first rotational angle relative to a center member of a modular reamer tool;

sliding the first removable reamer sleeve onto a first end of the center member of the modular reamer tool;

connecting the center member of the modular reamer tool with a first end member of the modular reamer tool, wherein the first removable reamer sleeve is disposed between a shoulder of the first end member and a first shoulder of the center member;

rotating a second removable reamer sleeve to a second rotational angle relative to the center member;

sliding the second removable reamer sleeve onto a second end of the center member; and connecting the center member with a second end member of the modular reamer tool, wherein the second removable reamer sleeve is disposed between a shoulder of the second end member and a second shoulder of the center member;

coupling the modular reamer tool to a drill string; and rotating the drill string in the wellbore, wherein the first removable reamer sleeve is configured for enlarging the wellbore.

16. The method of claim 15, further comprising:

wherein the second rotational angle is different from the first rotational angle.

17. The method of claim 15, further comprising:

disconnecting the first end member from the center member;

sliding the first removable reamer sleeve off the center member;

rotating the first removable reamer sleeve to a different rotational angle relative to the center member; and sliding the first removable reamer sleeve onto the first end of the center member.

18. The method of claim 15, wherein sliding the first removable reamer sleeve onto the first end of the center member of the modular reamer tool comprises:

engaging a first plurality of splines on an inner surface of the first removable reamer sleeve slidably with a second plurality of splines on an outer surface of the first end of the center member, wherein the first plurality of splines and the second plurality of splines comprise an equal number of splines.

19. The method of claim 15, further comprising:

removing the first end member from the modular reamer tool; and replacing the first end member with a replacement end member having different drill string thread characteristics.

* * * * *